US009359578B2

(12) United States Patent
Gieselman et al.

(10) Patent No.: US 9,359,578 B2
(45) Date of Patent: Jun. 7, 2016

(54) LUBRICATING COMPOSITION CONTAINING A DISPERSANT

(71) Applicant: The Lubrizol Corporation, Wickliffe, OH (US)

(72) Inventors: Matthew D. Gieselman, Wickliffe, OH (US); Joanne L. Jones, Nottingham (GB); Renee A. Eveland, Kirkland, OH (US); Patrick E. Mosier, Bay Village, OH (US); William Ellyatt, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/641,626

(22) Filed: Mar. 9, 2015

(65) Prior Publication Data

US 2015/0175930 A1 Jun. 25, 2015

Related U.S. Application Data

(63) Continuation of application No. 13/697,565, filed as application No. PCT/US2011/036787 on May 17, 2011, now abandoned.

(60) Provisional application No. 61/346,499, filed on May 20, 2010.

(51) Int. Cl.

| | |
|---|---|
| ***C07D 209/00*** | (2006.01) |
| ***C10M 105/56*** | (2006.01) |
| ***C10M 133/48*** | (2006.01) |
| ***C10M 161/00*** | (2006.01) |
| ***C10M 133/56*** | (2006.01) |
| ***C10M 149/02*** | (2006.01) |
| ***C10M 159/02*** | (2006.01) |
| ***C10M 133/12*** | (2006.01) |

(52) U.S. Cl.

CPC ..... *C10M 161/00* (2013.01); *C10M 133/12* (2013.01); *C10M 133/56* (2013.01); *C10M 149/02* (2013.01); *C10M 159/02* (2013.01); *C10M 2205/022* (2013.01); *C10M 2207/023* (2013.01); *C10M 2207/028* (2013.01); *C10M 2207/262* (2013.01); *C10M 2215/064* (2013.01); *C10M 2215/28* (2013.01); *C10M 2217/06* (2013.01); *C10M 2219/046* (2013.01); *C10M 2219/106* (2013.01); *C10M 2223/045* (2013.01); *C10N 2210/01* (2013.01); *C10N 2210/02* (2013.01); *C10N 2230/04* (2013.01); *C10N 2230/40* (2013.01); *C10N 2230/45* (2013.01); *C10N 2230/52* (2013.01); *C10N 2240/10* (2013.01); *C10N 2240/101* (2013.01); *C10N 2240/102* (2013.01); *C10N 2240/103* (2013.01); *C10N 2240/104* (2013.01); *C10N 2240/105* (2013.01)

(58) Field of Classification Search

CPC ..... C10M 133/44; C10M 173/02; C10M 2207/021; C10M 2217/044; C10M 2217/024; C10M 2223/04; C10M 2209/12; C10M 2209/104; C10M 2205/028; C10M 2201/062; C10M 2209/105; C10M 2219/104; C10M 2215/04; C10M 2209/102; C10M 2207/289; C10M 2227/061; C10M 2209/103; C10M 2207/40; C10M 2207/126; C10M 2207/127; C10M 2207/023; C10M 2215/224; C10M 2209/084; C10M 2221/04; C10M 2207/022; C10M 2207/125; C10M 2219/042; C10M 2217/045; C10M 2215/223; C10M 2205/022; C10M 2209/106; C10M 2205/026; C10M 2207/129; C10M 2201/087; C10N 2220/027; C10N 2240/404; C10N 2240/40; C10N 2210/01; C10N 2240/405; C10N 2210/02; C10N 2230/06; C10N 2230/12; C10N 2240/402; C10N 2270/00; C10N 2220/028; C10N 2240/401; C10N 2230/24; C10N 2270/02

USPC ..... 508/287, 296, 306, 307

See application file for complete search history.

(56) References Cited

U.S. PATENT DOCUMENTS

| | | | | |
|---|---|---|---|---|
| 4,863,623 | A | 9/1989 | Nalesnik et al. | |
| 5,102,566 | A * | 4/1992 | Fetterman, Jr. | C10M 141/10 508/294 |
| 5,182,041 | A | 1/1993 | Benfarmeo et al. | |
| 5,264,139 | A | 11/1993 | Mishra et al. | |
| 5,264,140 | A | 11/1993 | Mishra et al. | |
| 5,409,623 | A | 4/1995 | Mishra et al. | |
| 5,620,486 | A | 4/1997 | Cherpeck et al. | |
| 6,051,537 | A | 4/2000 | Emert et al. | |
| 6,107,257 | A | 8/2000 | Valcho et al. | |
| 6,107,258 | A | 8/2000 | Esche et al. | |
| 6,117,825 | A | 9/2000 | Liu et al. | |
| 2004/0014612 | A1 | 1/2004 | Esche et al. | |

(Continued)

FOREIGN PATENT DOCUMENTS

| | | |
|---|---|---|
| EP | 1533293 | 5/2005 |
| EP | 1884558 | 2/2008 |

(Continued)

OTHER PUBLICATIONS

EIC STIC 1700 Search Jan. 15, 2016.*

*Primary Examiner* — Pamela H Weiss

(74) *Attorney, Agent, or Firm* — Deron A. Cook, Esq.; Teresan W. Gilbert, Esq.

(57) ABSTRACT

The invention provides a lubricating composition containing a compound comprising the reaction product of a polyolefin, an ethylenically unsaturated aromatic acylating agent (or carboxylic reactant), and an amine, and an oil of lubricating viscosity. The invention further relates to the use of the lubricating composition in an internal combustion engine.

12 Claims, No Drawings

(56) References Cited

U.S. PATENT DOCUMENTS

| | | | | |
|---|---|---|---|---|
| 2004/0048753 | A1* | 3/2004 | Ritchie | C10M 141/06 508/232 |
| 2009/0305923 | A1 | 12/2009 | Visger et al. | |
| 2011/0306528 | A1 | 12/2011 | Gieselman et al. | |

FOREIGN PATENT DOCUMENTS

| | | |
|---|---|---|
| EP | 2083024 | 7/2009 |
| GB | 2441631 | 3/2008 |
| WO | 2010014655 | 2/2010 |
| WO | 2010062842 | 6/2010 |

* cited by examiner

LUBRICATING COMPOSITION CONTAINING A DISPERSANT

FIELD OF INVENTION

The invention provides a lubricating composition containing a dispersant and an oil of lubricating viscosity. The invention further relates to the use of the lubricating composition in an internal combustion engine.

BACKGROUND OF THE INVENTION

Engine manufacturers have focused on improving engine design in order to minimise emissions of particulates and pollutants, and improve cleanliness and fuel economy. One of the improvements in engine design is the use of exhaust gas recirculation (EGR) engines. Heavy duty diesel vehicles may use exhaust gas recirculation (EGR) engines in efforts to reduce environmental emissions. Whilst improvements in engine design and operation have contributed to reducing emissions, some engine design advances are believed to have generated other challenges for the lubricant. For example, EGR is believed to have led to increased formation and/or accumulation of soot and sludge. Among the consequences of recirculating the exhaust gas through the engine are different soot structures and increased viscosity of the oil at lower soot levels, compared with engines without EGR.

Increased soot-mediated oil thickening is common in heavy duty diesel engines. Some diesel engines employ EGR. The soot formed in an EGR engine has different structures and causes increased viscosity of engine lubricant at lower soot levels than formation of soot in the engine without an EGR.

Viscosity improvers are often used to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature.

Dispersant viscosity modifiers (DVMs) made from ethylene-propylene copolymers that have been radically grafted with maleic anhydride and reacted with various amines have shown desirable performance to prevent oil thickening in diesel engines. Aromatic amines are said to show good performance in this regard. DVMs of this type are disclosed in, for instance, U.S. Pat. Nos. 4,863,623, 5,264,139, 5,264,140, 5,620,486, 6,107,257, 6,107,258, and 6,117,825.

U.S. Pat. No. 5,409,623 discloses functionalized graft copolymers as viscosity index improvers, comprising an ethylene alpha-monoolefin copolymer grafted with an ethylenically unsaturated carboxylic acid material and derivatized with an azo-containing aromatic amine compound.

U.S. Pat. Nos. 5,264,139 and 5,264,140 disclose polymers derivatized with a sulphonyl-containing aromatic amine and an amide-containing aromatic amine material respectively.

Other dispersant viscosity modifiers have been contemplated in a variety of applications including U.S. patent applications Ser. No. 11/568,051, and 61/118,012; and International Application WO publication WO 2010/014655 A1.

U.S. patent application Ser. No. 11/568,051 discloses soot dispersants derived from esterified maleic anhydride-styrene interpolymers functionalized with nitrogen-containing moieties.

International Application WO publication WO2010014655 A1 discloses alpha olefin maleic anhydride (AOMA) interpolymers which may be esterified and further functionalized with amines having at least one condensable N—H group.

U.S. application 61/118,012 (also relating to International Patent Application WO2010/062842) discloses olefin polymers functionalized by grafting with an unsaturated carboxylic acid material and derivatized with aromatic amines having three or more non-contiguous aromatic groups.

Other publications disclose the possibility of dispersants with aromatic groups.

U.S. Pat. No. 5,182,041 discloses polyolefin based dispersants functionalized with an ethylenically unsaturated acylating agent and reacted with an amino-aromatic polyamine to produce antioxidant dispersants.

U.S. Pat. No. 6,051,537 discloses hydrocarbyl dispersants made from polyolefins functionalized with monounsaturated mono acid materials selected from acrylic acid, methacrylic acid and cinnamic acid reacted with amines, alcohols and/or aminoalcohols. These polyolefins have number average molecular weight in the range 1500 to 5000.

SUMMARY OF THE INVENTION

An objective of the present invention is to provide a lubricating composition capable of providing at least one of (i) a lubricating composition capable of reducing viscosity increase (often having a viscosity of less than 12 $mm^2$/sec (cSt) at 100° C. at a soot loading of 6 weight % or more), and/or (ii) a lubricating oil composition that maintains a relatively stable viscosity over a wide range of temperatures. This could be desirable because viscosity index improvers or DVMs may be employed to control viscosity over a wide temperature range and to control soot. It may also be desirable if a viscosity index improver were capable of achieving (i) and (ii).

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

In one embodiment the present invention provides a lubricating composition comprising an oil of lubricating viscosity and a compound comprising the reaction product of a polyolefin, an ethylenically unsaturated aromatic acylating agent (or carboxylic reactant), and an amine.

In one embodiment the present invention provides a lubricating composition comprising an oil of lubricating viscosity and a compound comprising the reaction product of a polyolefin, an ethylenically unsaturated aromatic acylating agent (or carboxylic reactant), and an aromatic amine (typically wherein the aromatic amine is not a heterocycle).

In one embodiment the present invention provides a lubricating composition comprising (i) an oil of lubricating viscosity, (ii) a compound comprising the reaction product of a polyolefin, an ethylenically unsaturated aromatic acylating agent (or carboxylic reactant), and an amine, and (iii) an overbased metal-containing detergent.

In one embodiment the lubricating composition disclosed herein has a sulphated ash content of 0.3 wt % to 1.2 wt %, or 0.5 wt % to 1.1 wt % of the lubricating composition. The sulphated ash content may be determined by ASTM D-874.

The compound disclosed herein may be borated, or non-borated, typically non-borated.

In one embodiment the invention provides a lubricating composition wherein the compound disclosed herein may be present at 0.1 wt % to 15 wt %, or 1 wt % to 14 wt %, or 2 wt % to 12 wt %, or 4 wt % to 9 wt % of the lubricating composition. Typically the compound is present at an actives level of about 50 wt % of the ranges quoted. In other words, on an actives basis the compound may be present at 0.05 to 7.5 wt %, or 0.5 wt % to 7 wt %, or 1 wt % to 6 wt %, or 2 wt % to 4.5 wt % of the lubricating composition.

In one embodiment the invention provides a lubricating composition comprising the compound disclosed herein and an alkylated diarylamine (such as an alkylated diphenylamine, or an alkylated phenylnapthylamine). The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl, diphenylamine, dinonyl diphenylamine, octyl diphenylamine, dioctyl diphenylamine, or mixtures thereof. In one embodiment the diphenylamine may include nonyl, diphenylamine, or dinonyl diphenylamine. The alkylated diarylamine may include octyl, di-octyl, nonyl, di-nonyl, decyl or di-decyl phenylnapthylamines.

When present, the alkylated diarylamine may be present at 0.01 wt % to 5 wt %, or 0.05 wt % to 3 wt %, or 0.1 wt % to 1 wt % of the lubricating composition.

In one embodiment the invention provides a lubricating composition wherein the compound as disclosed herein may be present at 2 wt % to 12 wt % (or typically 4 wt % to 9 wt %) and the alkylated diphenylamine may be present at 0.05 wt % to 3 wt % (or typically 0.1 wt % to 1 wt %) of the lubricating composition.

In one embodiment the invention provides a method of lubricating an internal combustion engine comprising supplying to the internal combustion engine a lubricating composition as disclosed herein.

In one embodiment the invention provides for the use of the compound described herein in a lubricant as a dispersant or dispersant viscosity modifier.

In one embodiment the invention provides for the use of the compound disclosed herein in a lubricant as a dispersant or dispersant viscosity modifier in an internal combustion engine lubricant. Typically the dispersant or dispersant viscosity modifier is useful to mitigate soot thickening in an engine lubricant.

DETAILED DESCRIPTION OF THE INVENTION

The present invention provides a lubricating composition, a method for lubricating an engine as disclosed above, and a use of the compound as disclosed above.

Polyolefin

The polyolefin may be a homopolymer or a copolymer. The polyolefin may be derivable (or derived) from an olefin with 2 to 20, or 2 to 10, or 2 to 4 carbon atoms. The polyolefin is known in the state of the art.

In one embodiment, the polyolefin may be a polybutene, typically a polyisobutylene. Typically the polyisobutylene has a number average molecular weight of 350 to 5000, or 550 to 3000 or 750 to 2500. Typically, when the reaction product of the invention is a homopolymer (such as polybutene) the homopolymer may be part of a dispersant.

When in the form of a copolymer, the polyolefin may be a copolymer of butene and isoprene, or an ethylene-α-olefin copolymer. In one embodiment the polyolefin may be a copolymer of an ethylene and propylene copolymer. Typically, when the reaction product of the invention is a copolymer the copolymer may be a dispersant viscosity modifier.

The number average molecular weight of a copolymer derivable from a butene and isoprene copolymer, or an ethylene-α-olefin copolymer may be 500 to 200,000, 5000 to 200,000, 5,000 to 100,000, or 5,000 to 75,000.

Ethylenically Unsaturated Aromatic Acylating Agent (or Carboxylic Reactant)

The ethylenically unsaturated aromatic acylating agent (or carboxylic reactant) may include cis-cinnamic acid, trans-cinnamic acid, phenylpropiolic acid, phenyl maleic anhydride, or mixtures thereof, or derivatives thereof (such esters, partial esters, amides, or partial amides (typically esters, or partial esters)). In one embodiment the ethylenically unsaturated aromatic acylating agent (or carboxylic reactant) may include cis-cinnamic acid, trans-cinnamic acid, phenylpropiolic acid, or mixtures thereof. In one embodiment the ethylenically unsaturated aromatic acylating agent (or carboxylic reactant) may include transcinnamic acid, or mixtures of cis and trans cinnamic acid.

In one embodiment the ethylenically unsaturated acylating agent may also include a derivative of cinnamic acid that may be represented by the formula:

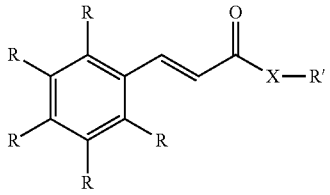

wherein

X may be —O—, >NR",

R' and R" may independently be hydrogen or a hydrocarbyl group (typically containing 1 to 50, or 1 to 20 carbon atoms, and R may independently be hydrogen, —OH, —OR, NR'R", or hydrocarbyl, and any two R groups together with other atoms may form 5 or 6 membered rings that may be saturated or unsaturated.

Examples of a derivative of cinnamic acid include 3,4-(methylenedioxy)cinnamic acid, 3,4,5-trimethoxy-trans-cinnamic acid, 4-(dimethylamine)cinnamic acid, sinapic acid, 2-hydroxycinnamic acid, 3,4-dimethoxycinnamic acid, 3-hydroxy-4-methoxycinnamic acid, 4-methoxycinnamic acid, α-methylcinnamic acid, caffeic acid, coumarin, trans-3-hydroxycinnamic acid, 4-hydroxy-3-phenyl-2(5H)-furanone, (E)-3-(naphthalene-2-yl)acrylic acid, trans-3-(4-methoxybenzoyl)acrylic acid, 3-indoleacrylic acid, 2,3-diphenylacrylic acid, or 3-(1-naphthyl)acrylic acid.

Amine

The amine may be a monoamine or a polyamine. The amine may be a linear or branched, cyclic or acyclic amine, or combinations thereof. When the amine is cyclic, the amine may be either an aromatic amine or a non-aromatic amine.

In one embodiment the amine may be acyclic, typically an acyclic polyamine. The polyamine may be an aliphatic polyamine such as an ethylenepolyamine, a propylenepolyamine, a butylenepolyamine, or mixtures thereof. In one embodiment the polyamine may be an ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

In one embodiment the amine may be an aromatic amine (typically wherein the aromatic amine is not a heterocycle). The aromatic amine includes aniline, nitroaniline, aminocarbazole, 4-aminodiphenylamine (ADPA), and coupling products (also referred to as coupled products) of ADPA. In one embodiment the amine may be 4-aminodiphenylamine (ADPA), or coupling products of ADPA.

Coupled products of ADPA may be represented by the formula (1):

Formula (1)

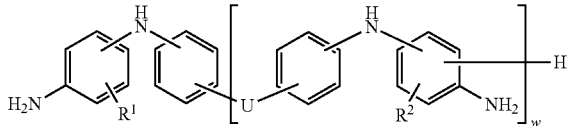

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

In one embodiment the coupled ADPA of Formula (1) may be represented by Formula (1a):

Formula (1a)

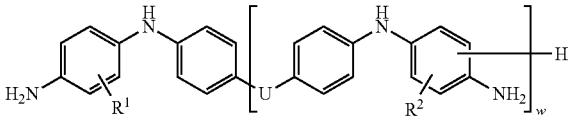

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

Alternatively, the compound of Formula (la) may also be represented by:

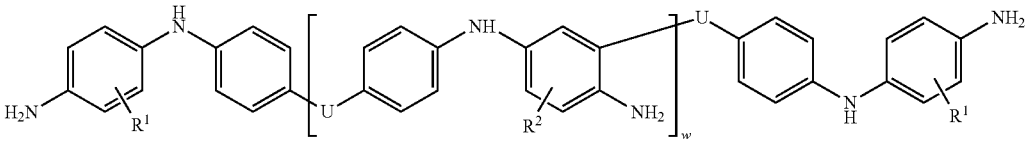

wherein each variable U, $R^1$, and $R^2$ are the same as described above and w is 0 to 9 or 0 to 3 or 0 to 1 (typically 0).

In one embodiment the aromatic amine may have at least 3 or aromatic groups. Examples of an amine having at least 3 aromatic groups may be represented by any of the following Formulae (2) and/or (3):

Formula (2)

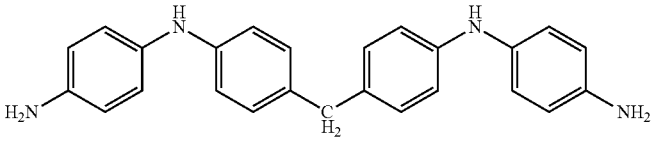

or

Formula (3)

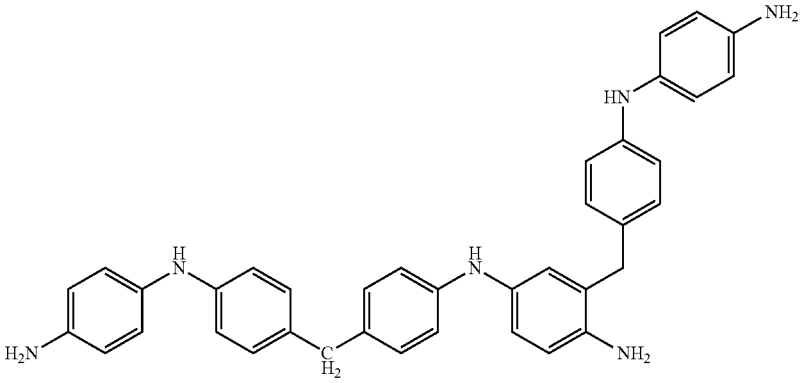

A coupled aromatic amine can be made by the reaction of an aromatic amine with an aldehyde (such as formaldehyde). A person skilled in the art will appreciate that compounds of Formulae (2) and (3) may also react with the aldehyde described below to form acridine derivatives. Acridine derivatives that may be formed include compounds represented by Formula (2a) or (3a) below. In addition to these compounds representing these formulae, a person skilled in the art will also appreciate that other acridine structures may be possible where the aldehyde reacts with other benzyl groups bridged with the >NH group. Examples of acridine structures include those represented by Formulae (2a) and (3 a):

Formula (2a)

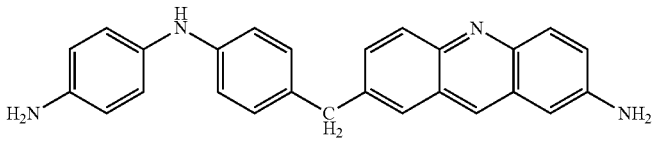

Formula (3a)

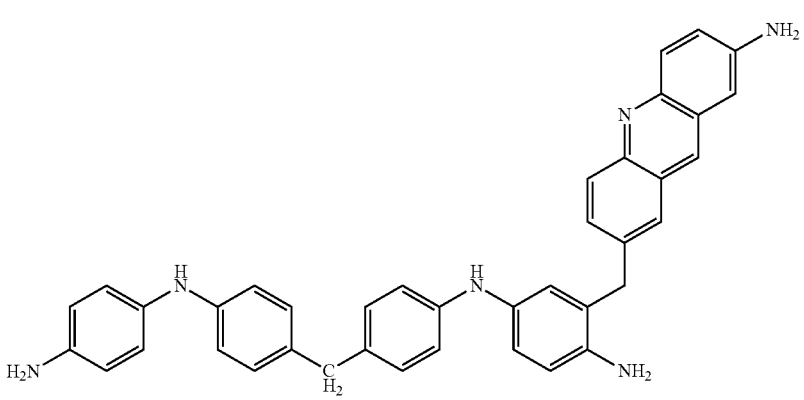

Any or all of the N-bridged aromatic rings are capable of such further condensation and perhaps aromatisation. One other of many possible structures is shown in Formula (3b).

Formula (3b)

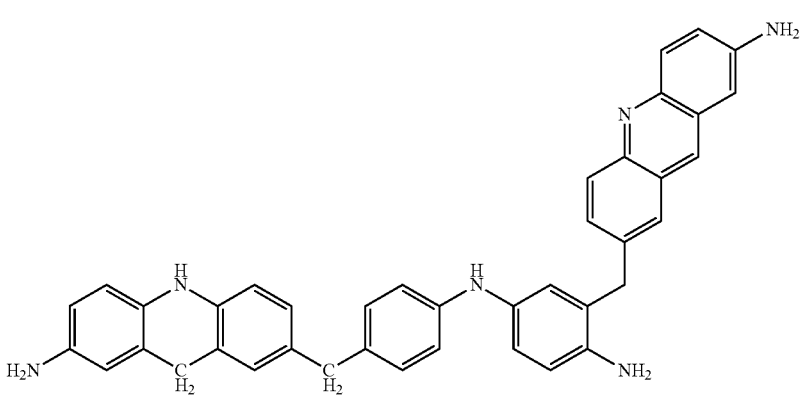

Examples of the coupled ADPA include bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine, $N^4$-{4-[4-(4-amino-phenylamino)-benzyl]-phenyl}-2-[4-(4-amino-phenylamino)-cyclohexa-1,5-dienylmethyl]-benzene-1,4-diamine, N-[4-(7-amino-acridin-2-ylmethyl)-phenyl]-benzene-1,4-diamine, or mixtures thereof.

The coupled ADPA may be prepared by a process comprising reacting the aromatic amine with an aldehyde. The aldehyde may be aliphatic, alicyclic or aromatic. The aliphatic aldehyde may be linear or branched. Examples of a suitable aromatic aldehyde include benzaldehyde or o-vanillin. Examples of an aliphatic aldehyde include formaldehyde (or a reactive equivalent thereof such as formalin or paraformaldehyde), ethanal or propanal. Typically the aldehyde may be formaldehyde or benzaldehyde.

The process may be carried out at a reaction temperature in the range of 40° C. to 180° C., or 50° C. to 170° C.

The reaction may or may not be carried out in the presence of a solvent. Examples of a suitable solvent include diluent oil, benzene, t-butyl benzene, toluene, xylene, chlorobenzene, hexane, tetrahydrofuran, water, or mixtures thereof.

The reaction may be performed in either air or an inert atmosphere. Examples of suitable inert atmosphere include nitrogen or argon, typically nitrogen.

Alternatively, the coupled ADPA may also be prepared by the methodology described in Berichte der Deutschen Chemischen Gesellschaft (1910), 43, 728-39.

The compound of the invention may be obtained/obtainable by a process comprising:

Step (1) reacting a polyolefin (typically a polybutene such as polyisobutylene) with an ethylenically unsaturated aromatic acylating agent (or carboxylic reactant); and Step (2) reacting the product of step (1) with an amine.

The polybutene may be reacted with chlorine to provide a substance capable of undergoing a Diels-Alder reaction with the ethylenically unsaturated acylating agent. Alternatively, the polybutene and/or the ethylene alpha olefin may be reacted with the ethylenically unsaturated acylating agent in the presence of a radical initiator.

The mole ratio of polyolefin to ethylenically unsaturated aromatic acylating agent (or carboxylic reactant) may range from 5:1 to 1:5, or 3:1 to 1:3, or 2:1 to 1:2, or 1:1. When the mole ratio is about 1:1 the product of step (1) is typically mono-substituted.

Step (2) of the process reacts an amine with the product of step (1) by processes known to a person skilled in the art. The mole ratio of the amine to the product of step (1) may vary from 0.3:1 or 0.5:1 or 1:1 or 2:1, to 3:1 or to 2:1, e.g., 0.5:1 to 2:1. In certain embodiments, the relative amounts may be expressed in terms of the ratio of nitrogen atoms to carbonyl groups, and typical N:CO ratios may include 0.5:1 to 5:1. Typically the product of step (2) is in the form an amide.

When the polyolefin is a polyisobutylene, the ethylenically unsaturated acylating agent is trans-cinnamic acid, and any amine disclosed herein are reacted, the product formed may be represented by formulae:

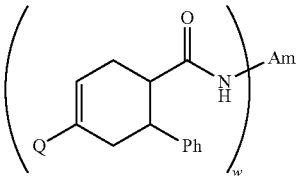

(typical product from Diels-Alder reaction) or

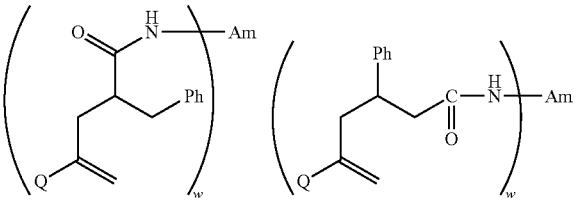

(typical products from "ene" reaction)

wherein w may be 1 to 5, or 1 to 3 (depending on the mole ratio of the product of the amine to the product of step (1) or step (i));

Q may be the residue of polybutene;

Ph may be phenyl group derivable from trans-cinnamic acid; and Am may be the residue of the amine reacted.

The compound of the invention may be obtained/obtainable by a process comprising (i) reacting a polyolefin copolymer (typically an ethylene-α-olefin copolymer) with an ethylenically unsaturated aromatic acylating agent (or carboxylic reactant); and (ii) reacting the product of (i) with an amine.

The ethylenically unsaturated aromatic acylating agent (or carboxylic reactant) may be grafted onto the polyolefin copolymer (typically an ethylene/propylene copolymer) in a number of ways. It may be grafted onto the polymer in solution or in molten form using a radical initiator. The free-radical induced grafting of ethylenically unsaturated carboxylic acid materials may also be conducted in solvents, such as hexane or mineral oil. It may be carried out at an elevated temperature in the range of 100° C. to 250° such as 120° C. to 190° C. or 150° C. to 180° C. If grafting is conducted in a solvent such as a mineral lubricating oil solution, the solution may contain 1 wt % to 50 wt %, or 5 wt % to 30 wt % based on the initial total oil solution, of the polyolefin copolymer, typically under an inert environment.

The free-radical initiators which may be used include peroxides, hydroperoxides, and azo compounds, typically those which have a boiling point greater than about 100° C. and which decompose thermally within the grafting temperature range to provide free radicals. Representative of these free-radical initiators include azobisisobutyronitrile and 2,5-dimethyl-hex-3-yne-2,5-bis-tertiary-butyl peroxide. The initiator is typically used in an amount of 0.005 wt % to 1 wt % based on the weight of the reaction mixture solution. The grafting is typically carried out in an inert atmosphere, such as under nitrogen blanketing. The resulting polymer intermediate is characterized by having the aromatic acylating functions within its structure.

In a melt process for forming a graft polymer, the ethylenically unsaturated aromatic acylating agent (or carboxylic reactant), with the optional use of a radical initiator, is grafted onto molten rubber using rubber masticating or shearing equipment. The temperature of the molten material in this process may be 70° C. to 250° C. Optionally, as a part of this process or separate from this process, mechanical shear and elevated temperatures can be used to reduce the molecular weight of the copolymer to a value that will eventually provide the desired level of shear stability for the lubricant application. In one embodiment, such mastication can be done in a twin screw extruder properly configured to provide high shear zones, capable of breaking down the polymer to the desired molecular weight. Shear degradation can be done before or after grafting with the maleic anhydride. It can be done in the absence or presence of oxygen. The shearing and grafting steps can be done in the same extruder or in separate extruders, in any order.

In an alternative embodiment, the ethylenically unsaturated aromatic acylating agent (or carboxylic reactant), may be first condensed with an amine (as described herein) and the condensation product itself then grafted onto the polymer backbone in analogous fashion to that described above.

The amount of the ethylenically unsaturated aromatic acylating agent (or carboxylic reactant) on the polymer chain, and in particular the amount of grafted carboxylic acid on the chain is typically 1 wt % to 5 wt % based on the weight of the polyolefin backbone, and in an alternative embodiments 1.5 wt % to 4 wt 5, or 1.5 wt % to 3.5 wt %. These numbers represent the amount of ethylenically unsaturated aromatic acylating agent (or carboxylic reactant) monomer and may be adjusted to account for acid monomers having higher or lower molecular weights or greater or lesser amounts of acid functionality per molecule, as will be apparent to the person skilled in the art The product of step (i) may then be functionalised by the amine in step (2). This reaction step is similar to that described above for polybutene.

The product of step (ii) may in some instances be a dispersant viscosity modifier (DVM).

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] and in the corresponding paragraphs of US-2010-0197536. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

A lubricating composition may be prepared by adding the product of the process described herein to an oil of lubricating viscosity, optionally in the presence of other performance additives (as described herein below).

Other Performance Additives

The composition optionally comprises other performance additives. The other performance additives include at least one of metal deactivators, viscosity modifiers, detergents, friction modifiers, antiwear agents, corrosion inhibitors, dispersants (other than the compound of the invention), dispersant viscosity modifiers (other than the compound of the invention), extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant (other than the compound of the invention), an antiwear agent, a dispersant viscosity modifier (other than the compound of the invention), a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The dispersant may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed descriptions of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008], and preparative examples are described paragraphs [0065] to [0073]).

In one embodiment the invention provides a lubricating composition which further includes a phosphorus-containing antiwear agent. Typically the phosphorus-containing antiwear agent may be a zinc dialkyldithiophosphate, a phosphite, phosphate, phosphonate, ammonium phosphate salt, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound.

The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased metal-containing detergent. The metal of the metal-containing detergent may be zinc, sodium, calcium or magnesium.

The overbased metal-containing detergent may be selected from the group consisting of non-sulphur containing phenates, sulphur containing phenates, sulphonates, salixarates, salicylates, and mixtures thereof.

The overbased metal-containing detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased metal-containing detergent may be a zinc, sodium, calcium or magnesium salt of a phenate, sulphur containing phenate, sulphonate, salixarate or salicylate. Overbased salixarates, phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy.

Typically the overbased metal-containing detergent may be a calcium or magnesium overbased detergent Overbased detergents are known in the art. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Second Edition, Edited by R. M. Mortier and S. T. Orszulik, Copyright 1997. In one embodiment, the lubricant composition comprises at least one overbased detergent with a metal ratio of at least 3, or at least 8, or at least 15.

The overbased detergent may be present at 0 wt % to 15 wt %, or 0.1 wt % to 10 wt %, or 0.2 wt % to 8 wt %, or 0.2 wt % to 3 wt %. For example, in a heavy duty diesel engine the detergent may be present at 2 wt % to 3 wt % of the lubricating composition. Similarly, for example, in a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt % of the lubricating composition.

Antioxidants include sulphurised olefins, alkylated diphenylamines (as described previously), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment the friction modifier may be selected from the group consisting of long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

As used herein the term "fatty" or "fatty alkyl" means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

Other performance additives such as corrosion inhibitors include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include silicones such as polysiloxanes, copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Compound of the Invention | 0.1 to 15 | 1 to 14 | 4 to 9 |
| Dispersant | 0 to 12 | 0 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 13 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Industrial Application

The lubricating composition may be utilised in an internal combustion engine. The engine components may have a surface of steel or aluminium (typically a surface of steel).

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine. In one embodiment the internal combustion engine may be a heavy duty diesel engine. In one embodiment the internal combustion engine may be a heavy duty diesel engine equipped with exhaust gas recirculation.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.4 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.1 wt % of the lubricating composition. In one embodiment the sulphated ash content may be 0.5 wt % to 1.1 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

The following examples provide illustrations of the invention. These examples are non-exhaustive and are not intended to limit the scope of the invention.

EXAMPLES

Preparative Example 1 (EX1)

A 5 L 5 neck flask is charged with 1326.8 g of polyisobutylene (vinylidene content of 5-8 mol %, and number average molecular weight of about 2050) and 1044 g of hexane. A thermocouple, water condenser and two subsurface gas inlet tubes are connected to the flask. Prior to the gas inlet, two sinter gas filters, air trap and flow meter are connected. Prior to the flow meter an air trap is connected. After the condenser, a dry-ice tap, air trap, o-toluidine trap, water trap (500 mL) and caustic trap are connected. The contents of the flask are stirred for 2 hours. The flask is then heated to 65° C. and 58 g of chlorine is added over a period of 4 hours. The reaction is blown with nitrogen gas for 30 minutes, before cooling to ambient temperature. The flask is then heated to 130° C. over 4 hours to remove hexane under vacuum. The reaction yields 1293.5 g of product.

Preparative Example 2 (EX2)

979.4 g of the product of EX1 and 982.4 g of dodecane are charged into a 500 ml flask. The flask has a Friedrichs condenser attached and Tygon™ tubing from the condenser outlet to a caustic trap. The thermocouple is placed in a pocket to prevent corrosion and a PTFE stirrer is used. The contents of the flask are stirred for 30 minutes at 50° C. Trans-cinnamic acid (146.5 g) is then added at room temperature via a powder funnel. The resulting mixture is stirred (250 rpm) and heated to 90° C. under nitrogen. The mixture is then heated to 180° C. over 1 hour and held at 180° C. for 18 hours. The reaction is then vacuum stripped over 7 hours while increasing the temperature from 150° C. to 200° C., before cooling to ambient temperature.

Preparative Example 3 (EX3)

292.7 g of the product of EX1 and 250 g of dodecane are charged into a 1 L flask. The flask has a Friedrichs condenser attached and Tygon™ tubing from the condenser outlet to a caustic trap. The thermocouple is placed in a pocket to prevent corrosion and a PTFE stirrer is used. The contents of the flask are stirred for 30 minutes at 50° C. before cooling to ambient temperature. 32.5 g of phenylpropiolic acid is added in one portion. The resulting mixture is stirred (250 rpm) and heated to 90° C. under nitrogen. The mixture is then heated to 180° C. over 1.5 hour and held at 180° C. for 18 hours. The reaction is then vacuum stripped over 10 hours while increasing the temperature from 150° C. to 200° C., before cooling to ambient temperature.

Preparative Example 4 (EX4)

230.3 g of the product of EX2 and 235.4 g of diluent oil are placed in a 1 L flask and heated to 110° C. under a nitrogen atmosphere. The contents of the flask are stirred at 200 rpm. 6.6 g of triethylenetetramine is added dropwise (subsurface) over a period of 10 minutes. The temperature is increased to 155° C. over a period of 15 minutes. The flask is held at 155° C. for 4 hours.

Preparative Example 5 (EX5)

254.3 g of the product of EX2, 275.2 g of diluent oil are placed in a 1 L flask and heated to 110° C. under a nitrogen atmosphere. The contents of the flask are stirred at 200 rpm. 21.7 g of 4-aminodiphenylamine is added portionwise via a powder funnel over 5 minutes. The temperature is increased to 155° C. and held for 12 hours and then raised to at 180° C. and held for 5 hours. The flask is cooled to 100° C. and filtered over a period of 1 hour. The flask is then cooled to ambient temperature.

Preparative Example 6 (EX6)

A 2-L four neck flask equipped with an overhead stirrer, thermowell, subsurface nitrogen feed topped with addition funnel, and condenser is charged with 8000 Mn olefin copolymer (derived from ethylene and propylene) (500.0 g), trans-cinnamic acid (10.0 g) and t-butyl benzene (1000 mL) and heated to 150° C. A solution of t-butyl peroxide (4.9 g) in t-butyl benzene (100 mL) is charged to the addition funnel and added to the flask subsurface over 60 min. The reaction is stirred at 150° C. for an additional 5 hours, then vacuum stripped at reduced pressure. A viscous product is obtained (510.0 g).

Preparative Example 7 (EX7)

A 3-L, 4-neck flask equipped with an overhead stirrer, thermowell, subsurface inlet with nitrogen line, and Dean-Stark trap with condenser is charged with the product of EX6 (510.0 g) and diluent oil (1107.3 g) and heated to 110° C. Dimethylaminopropylamine (6.8 g) is added in one portion, subsurface. The temperature is then raised to 160° C. and held at that temperature for 10 hours. The resultant product is a dark viscous oil (1628.4 g).

A series of SAE 15W-40 heavy duty diesel engine lubricants (IVL1 to IVL3) are prepared containing antioxidants (mixture hindered phenols and alkylated diphenylamines), 1.09 wt % of zinc dialkyldithiophosphate, a mixture of detergents (including calcium sulphonate and calcium phenate), 0.2 wt % of 2-tert-nonyldithio-5-mercapto-1,3,4-thiadiazole and further containing 2 wt % of a dispersant viscosity modifier as described in International Publication WO2006/015130 (see preparative examples described in paragraphs [0065] to [0073]). IVL1, IVL2 and IVL3 contain 4.1 wt % of EX4, EX5 and EX7 respectively.

Comparative Example 1 (CE1) is a SAE 15W-40 engine lubricant similar to IVL1, except it replaces the reaction product of the present invention with 4.1 wt % of a succinimide dispersant.

IVL1 to IVL2 and CE1 are evaluated for performance for soot dispersancy. The lubricants are stressed by addition of 1 vol % of a 17.4 M mixture of sulphuric and nitric acid (10:1) (amount of acid calculated to reduce TBN by 11). The acid stressed samples are top treated with 6 wt % carbon black (soot model) and 5 wt % diesel fuel. The lubricant mixture is the homogenised in a tissumizer to make a slurry. The slurry is then sonicated to completely disperse the carbon black. The dispersed sample is stored at 90° C. for 7 days while blowing 0.5 cc $min^{-1}$ of 0.27% nitrous oxide in air through the sample. 25 microliter aliquots of sample are blotted onto chromatography paper once daily. After curing the filter paper for 2 hours at 90° C., the ratio of the diameter of the internal carbon black containing spot to the external oil spot (X100) is measured, averaged over 7 days and reported in the table as soot ratio. Higher soot ratio indicates improved soot dispersion. The results obtained are as follows:

| | CE1 | IVL1 | IVL2 | IVL3 |
|---|---|---|---|---|
| Soot Ratio | 43 | 70 | 72 | N.M. |

Footnote:
N.M. indicates not measured.

The results indicate that high soot ratio correlates to better soot dispersion.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704 and paragraphs [0137] to [0141] of published application US 2010-0197536.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and 0.1 wt % to 15 wt % of a compound comprising the reaction product of a polyolefin wherein the polyolefin is polyisobutylene, an ethylenically unsaturated aromatic acylating agent, and an aromatic amine, wherein the aromatic amine is selected from the group consisting of aniline, nitro aniline, aminocarbazole, 4-aminodiphenylamine (ADPA), and coupling products of ADPA.

2. The lubricating composition of claim 1, wherein the aromatic amine is 4-aminodiphenylamine or coupling products of 4-aminodiphenylamine.

3. The lubricating composition of claim 1, wherein the aromatic amine is coupling products of 4-aminodiphenylamine.

4. The lubricating composition of claim 1, wherein the polyisobutylene has a number average molecular weight of 350 to 5000.

5. The lubricating composition of claim 1, wherein the polyisobutylene has a number average molecular weight of 550 to 3000.

6. The lubricating composition of claim 1, wherein the polyisobutylene has a number average molecular weight of 750 to 2500.

7. The lubricating composition of claim 1, wherein the ethylenically unsaturated aromatic acylating agent is chosen from cis-cinnamic acid, trans-cinnamic acid, phenylpropiolic acid, phenyl maleic anhydride, or mixtures thereof, or derivatives thereof.

8. The lubricating composition of claim 1, wherein the ethylenically unsaturated aromatic acylating agent is cis-cinnamic acid, trans-cinnamic acid, phenylpropiolic acid, or mixtures thereof.

9. The lubricating composition of claim 1, wherein the ethylenically unsaturated aromatic acylating agent is trans-cinnamic acid, or mixtures of cis and trans cinnamic acid.

10. The lubricating composition of claim 1, wherein the ethylenically unsaturated aromatic acylating agent is trans-cinnamic acid.

11. The lubricating composition of claim 1, wherein the lubricating composition has a sulphated ash content of 0.5 wt % to 1.1 wt % of the lubricating composition.

12. A method of lubricating an internal combustion engine comprising supplying to the internal combustion engine a lubricating composition comprising the lubricating composition of claim 1.

* * * * *